US007559175B2

(12) United States Patent
da Costa Lima

(10) Patent No.: US 7,559,175 B2
(45) Date of Patent: Jul. 14, 2009

(54) CONSTRUCTIVE DISPOSITION USED IN THE CONSTRUCTION OF BUILDINGS

(76) Inventor: Gilmar da Costa Lima, Rua Maria Isabel Zagonel, 205, Bairro Afonso Pena, São José dos Pinhais/PR (BR) 83045-430

( * ) Notice: Subject to any disclaimer, the term of this patent is extended or adjusted under 35 U.S.C. 154(b) by 610 days.

(21) Appl. No.: 11/008,696

(22) Filed: Dec. 9, 2004

(65) Prior Publication Data

US 2006/0080929 A1 Apr. 20, 2006

(30) Foreign Application Priority Data

Oct. 20, 2004 (BR) ..... 8402490 U

(51) Int. Cl.
*E04H 6/00* (2006.01)

(52) U.S. Cl. ..... 52/79.9; 52/81.3; 52/82; 52/93.1; 403/172

(58) Field of Classification Search ..... 52/82, 52/81.1, 81.3, 79.4, 712, 90.2, 93.1, 93.2, 52/236.1, 79.9, 79.1; 403/172
See application file for complete search history.

(56) References Cited

U.S. PATENT DOCUMENTS 2,270,161 A * 1/1942 Briggs ..... 52/93.2
2,959,256 A * 11/1960 Deam ..... 52/236.1
4,007,075 A * 2/1977 McClain et al. ..... 156/62.2
4,275,534 A * 6/1981 Porter ..... 52/82
4,395,154 A * 7/1983 Phillips et al. ..... 403/172
5,088,245 A * 2/1992 Anderson ..... 52/82
5,765,316 A * 6/1998 Kavarsky ..... 52/67
6,345,638 B1 * 2/2002 Warner ..... 135/123
6,959,515 B1 * 11/2005 Beighton ..... 52/79.9
2004/0049992 A1 * 3/2004 Seavy ..... 52/79.1

* cited by examiner

*Primary Examiner*—Richard E Chilcot, Jr.
*Assistant Examiner*—Chi Q Nguyen
(74) *Attorney, Agent, or Firm*—Alston & Bird LLP

(57) ABSTRACT

The present invention provides a modular construction system to be applied to buildings, comprising a steel structure composed by octagonal tubing that acts as external beams, octagonal tubing that acts as external beams, octagonal tubing that acts as internal beams, structural connections, cross members for the roof structure, a hollow roof ridge member, panels acting as structural walls and partitions, bracing plates to connect the panels, external finishing member and internal finishing member, whereas the whole structure is anchored to the floor. When creating an edge column to connect the panels to the steel structure, internal angular shaped bracing plates are used and external ones with a shape similar to letter "C", provided with holes along the length for the bolts and connection slot to connect the external finishing member by means of internal clips with a rim for connection to the clamp through the recesses arranged in the interior. When there is a need to create an intermediate column in the junction of three panels, a bracing plate will be used which also has a connection slot to connect to the external finishing member, by means of internal clips, with a rim to connect to the clamp through the recesses arranged in the interior, internally connected by the bracing plates similar to the letter "T", furthermore connected by the spacer, to finally receive the internal finishing member which has a shape similar to the letter "L". In order to connect two panels to compose an intermediate column, two bracing plates will be used with a connection slot to connect to the external finishing member by means of internal clips, with a rim to connect to the clamp through the recesses arranged in its interior.

4 Claims, 10 Drawing Sheets

CONSTRUCTIVE DISPOSITION USED IN THE CONSTRUCTION OF BUILDINGS

FIELD OF THE INVENTION

The present invention provides a new constructive arrangement applied to buildings, presenting a low cost and fast installation modular set-up using the most recent materials and bearing characteristics that facilitate the adaptation to any site, offering high quality, durability, easy maintenance and possibilities of expansion.

BACKGROUND OF THE INVENTION

Nowadays, all kinds of materials are used for the construction of modular housing, such as pre-cut wood, steel, concrete panels, dry walls, etc. However, this type of modular conventional construction has the inconvenience of mixing a great variety of materials, which somewhat complicates the construction process, sometimes requiring welding operations when the building structure is composed of steel tubing, generating noxious gases to the operators. In addition, the use of cement aggravates the conditions of neatness of the job site.

SUMMARY OF THE INVENTION

The objective of the present invention is to present a modular construction system to be applied to buildings so as to facilitate and expedite the erection of the building and reduce to the very minimum the handling of parts and components. This result is achieved through a new building conception, which uses a structure developed from octagonal cross section tubing, produced from hot rolled seamed structural steel with adequate thickness. The structure also comprises roof trusses and purlins and square steel plates to anchor the columns to the floor. The tubular components are combined by means of octagonal connecting members and bolts to assure perfect rigidity of the structure. Wall bracing plates connect thermo-acoustical and fire resistant panels to the tubular framework so as to assure full stability of the structure. In developing this system, full attention was dedicated to assure the best technical use of each material, thus eliminating waste and reducing the required resources during the construction/installation phases.

The proposed constructive arrangement offers the following advantages when compared with other conventional modular constructions:

- The erection is developed in an ambient with a reduced number of parts and components;
- The construction process is so simple it does not require skilled labor;
- The number of construction steps is substantially reduced;
- The job site is very clean due to the elimination of welding, cement and plaster;
- The workers are not exposed to noxious gases from welding and grinding operations;
- The environment is preserved since no waste is generated.

BRIEF DESCRIPTION OF THE DRAWINGS

The details of this new constructive arrangement applied to buildings, as well as its advantages, are depicted in the following figures.

DETAILED DESCRIPTION OF THE PREFERRED EMBODIMENT

Figure 1:
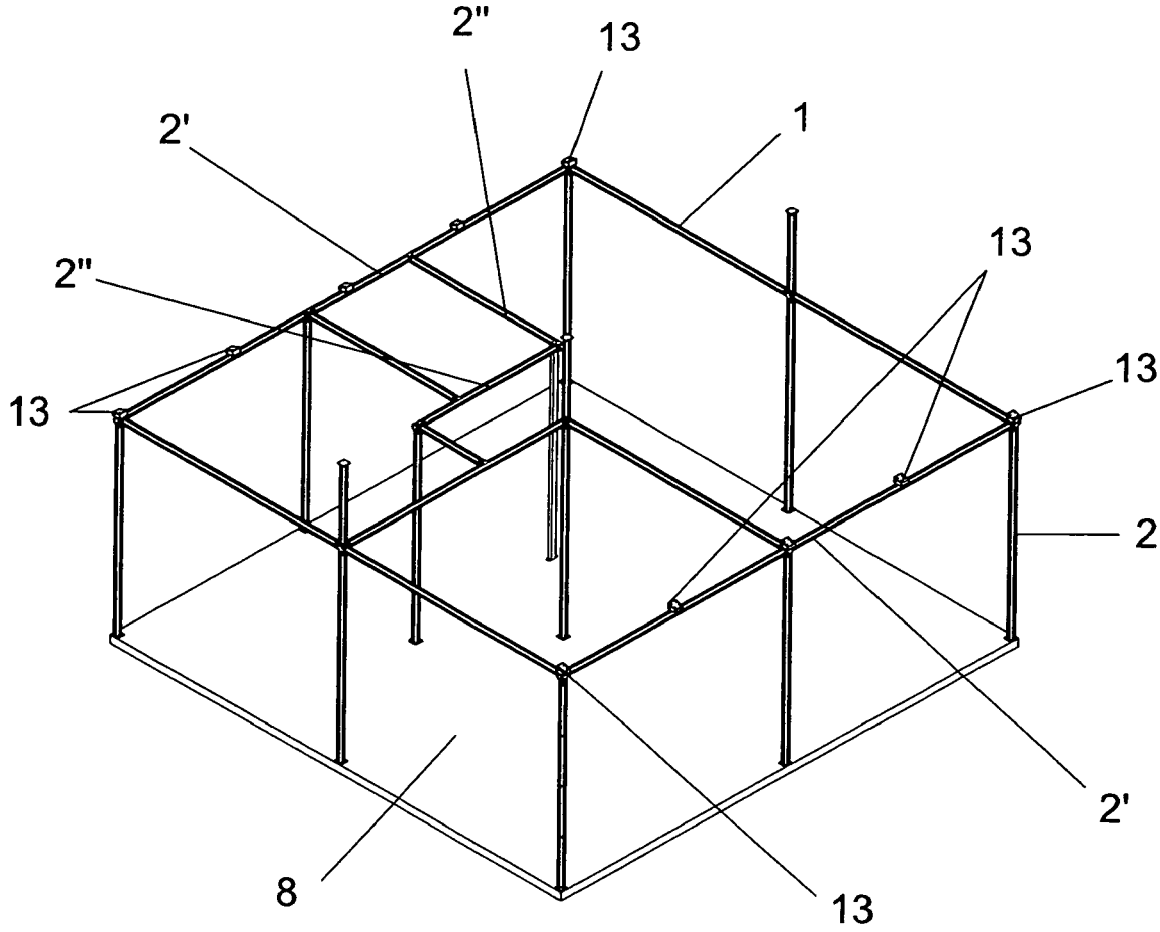
FIG. 1—perspective of the octagonal tubular structure, location of the columns, beams, support, connections and anchor plates of the truss and floor.
Figure 2:
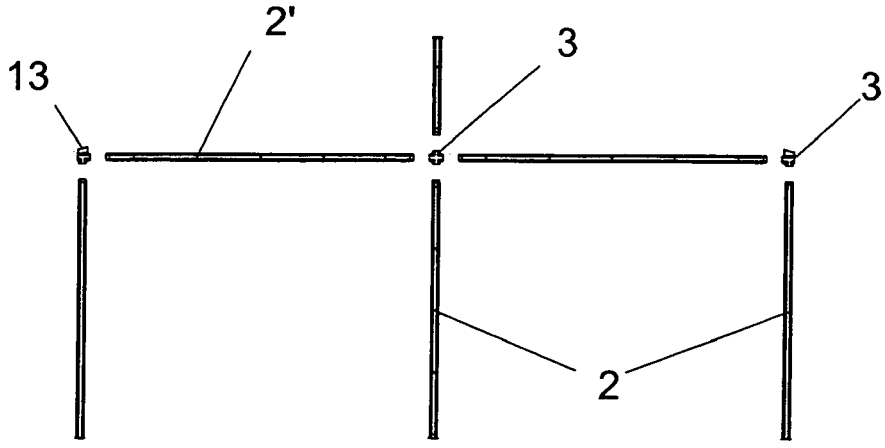
FIG. 2—exploded view of the tubular structure.
Figure 3:
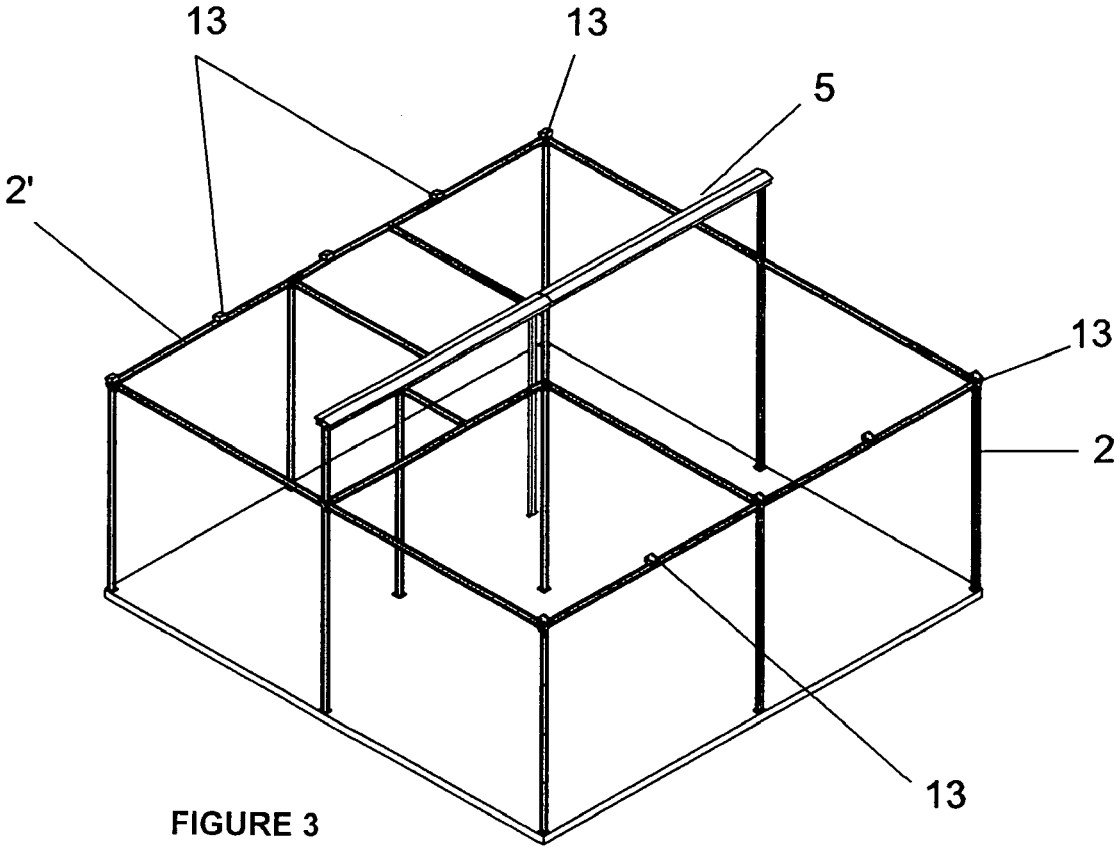
FIG. 3—perspective of the octagonal tubular structure, location of the columns, beams, support, connections and truss anchor plates, floor and roof ridge.
Figure 4:
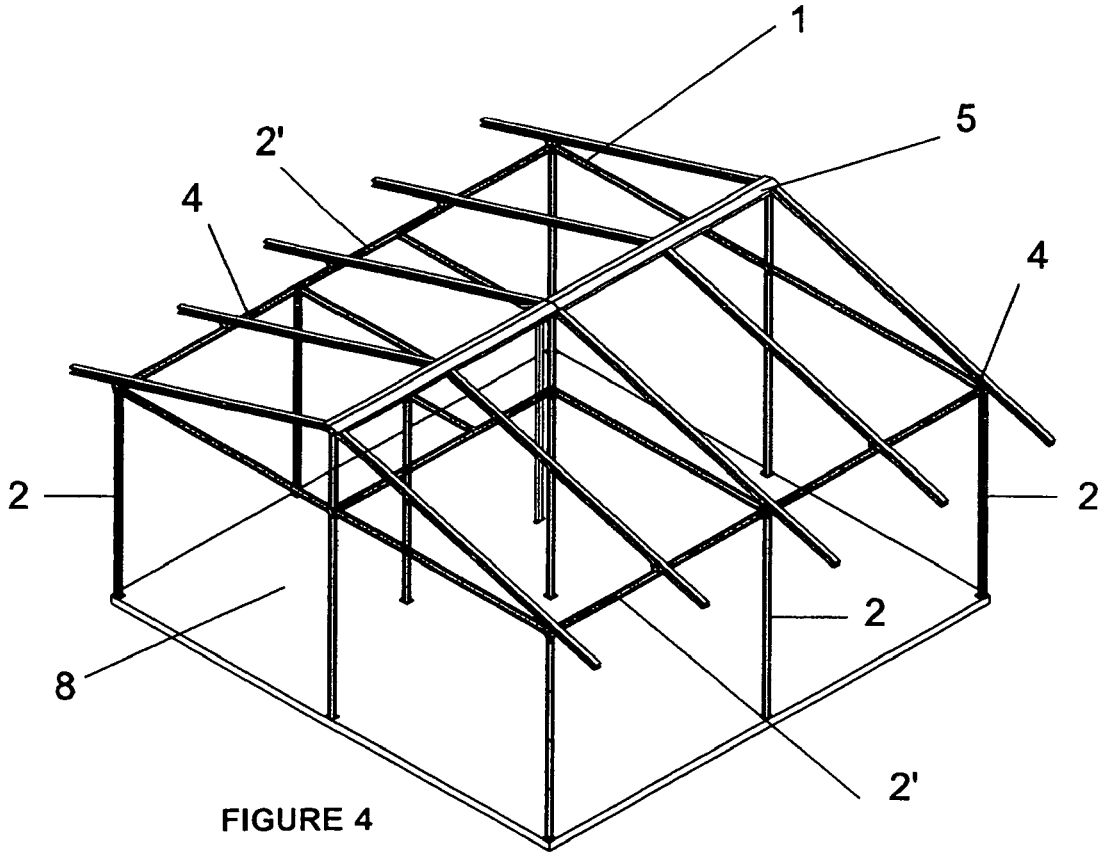
FIG. 4—perspective of the octagonal tubular structure, showing the columns, beams, support, connections, truss and purlin anchor plates for the subsequent installation of the wall.
Figure 5:
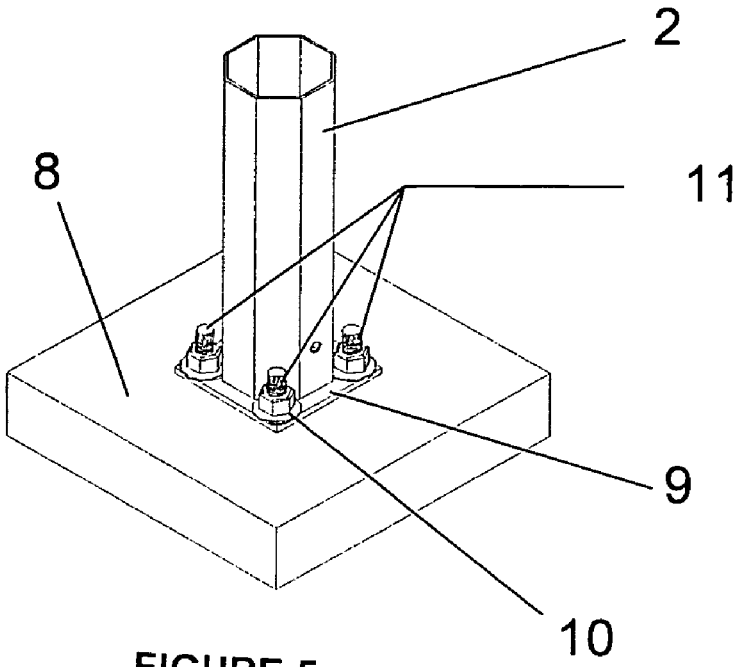
FIG. 5—perspectives of columns and base.
Figure 6:
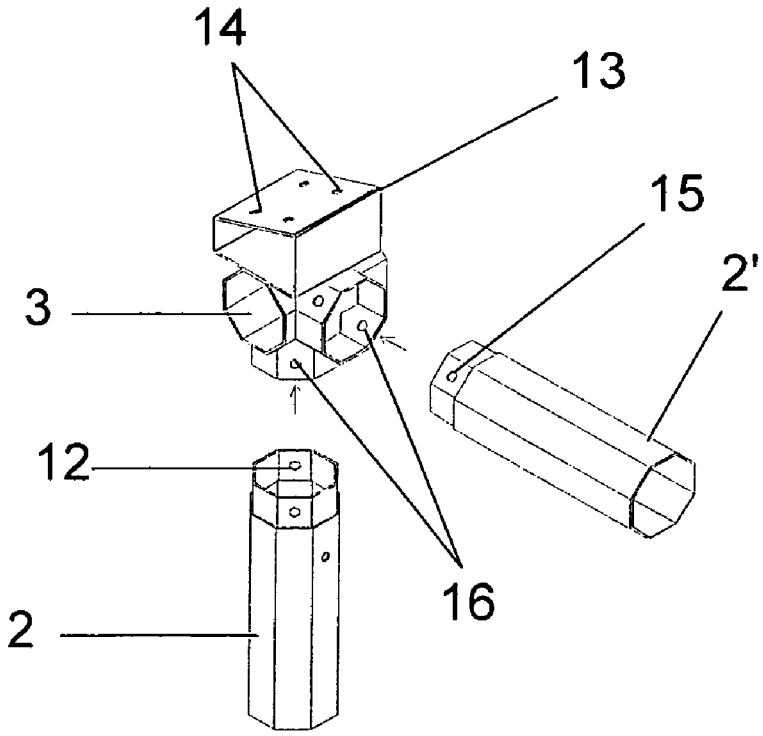
FIGS. 6, 7, 8, 9, 10, 11 and 12—perspective of the connections to anchor the columns, beams and construction support.
Figure 7:
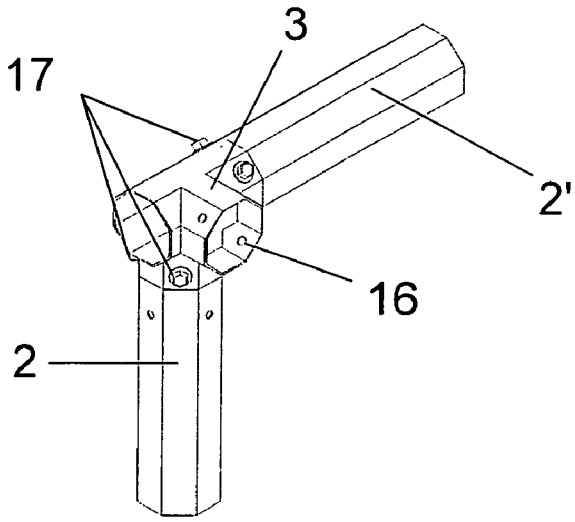
Figure 9:
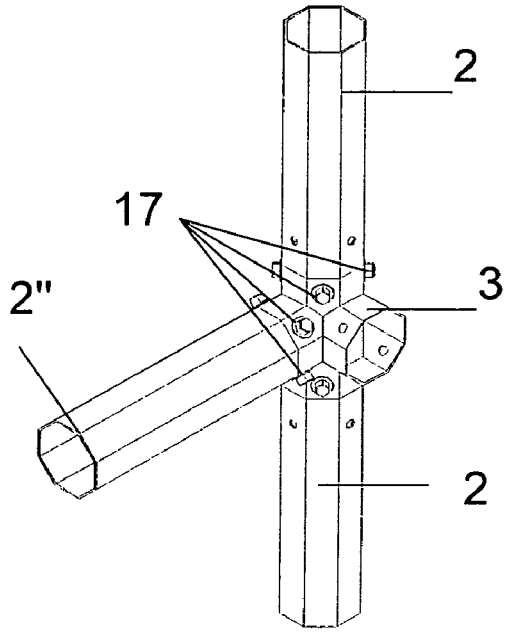
Figure 8:
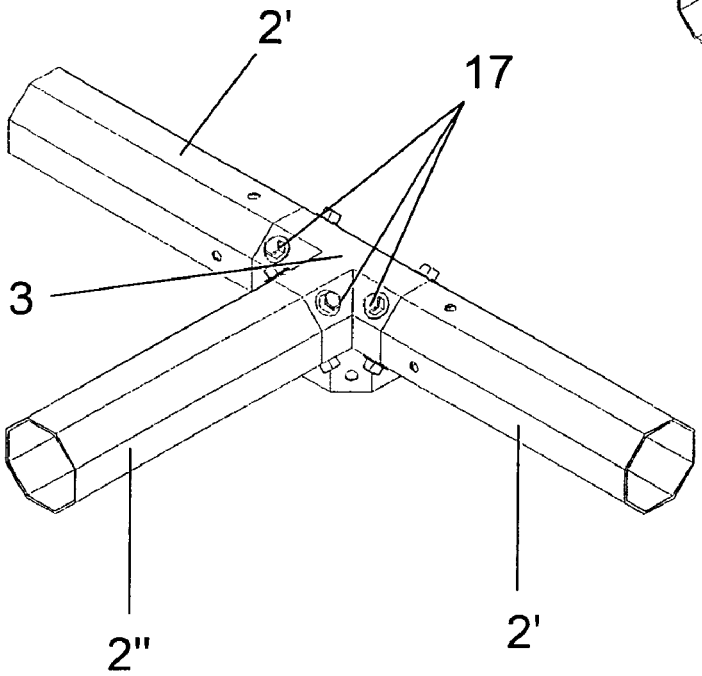
Figure 10:
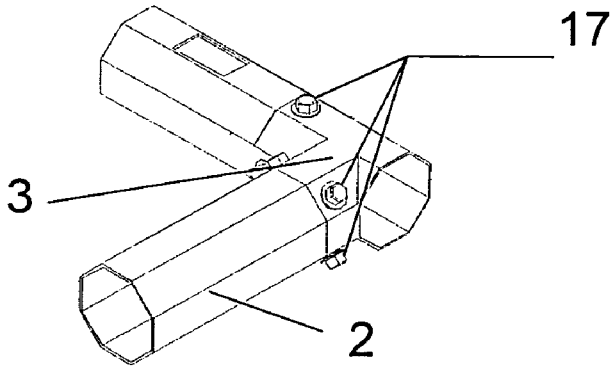
Figure 12:
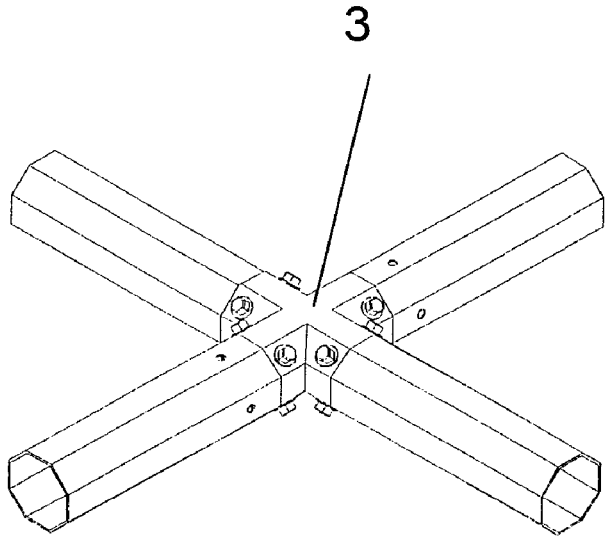
Figure 11:
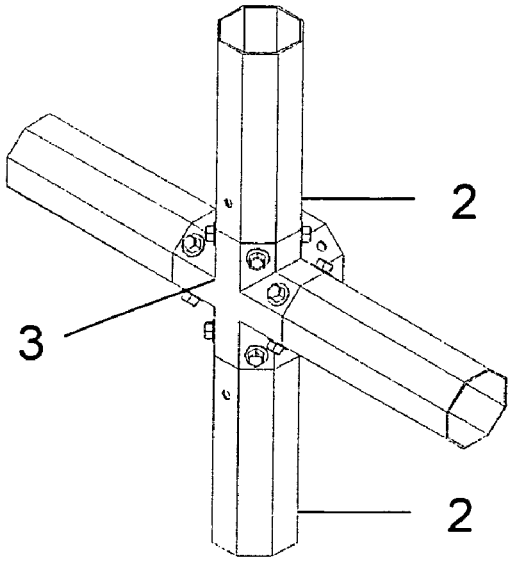
Figure 13:
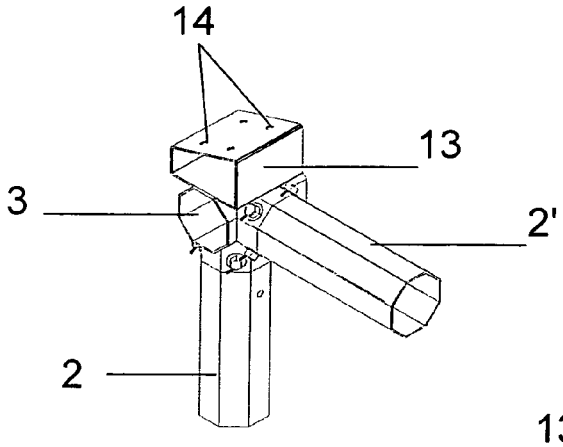
FIG. 13—perspective of the connections to anchor the edge supports for the truss bearing.
Figure 15:
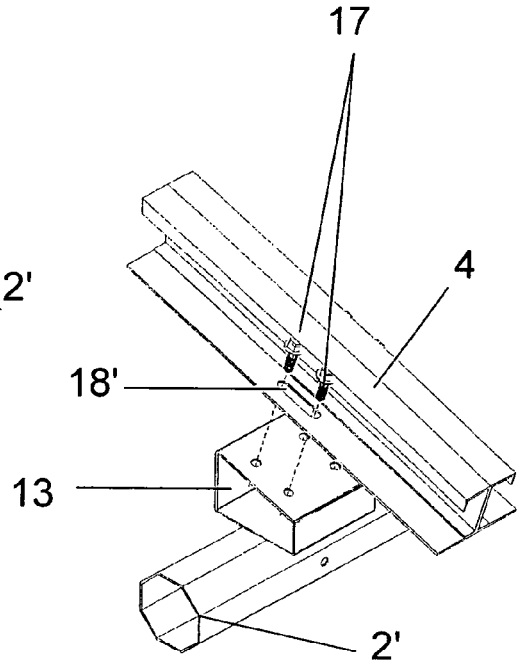
FIG. 15—perspective of the connection of the trusses to the intermediate supports.
Figure 14:
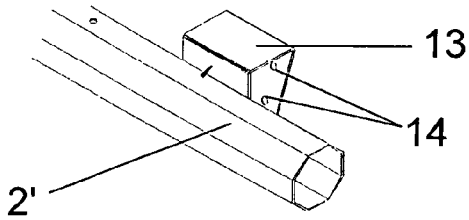
FIG. 14—perspective of the beams to receive the intermediate supports for the trusses.
Figure 16:
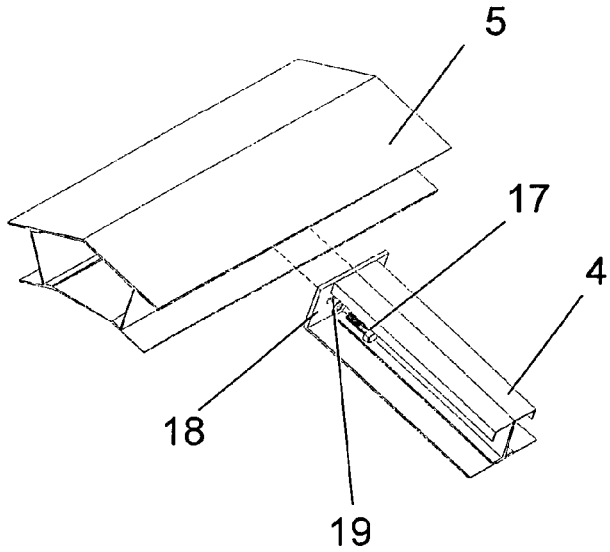
FIG. 16—perspective of the connection of the trusses to the roof ridge.
Figure 17:
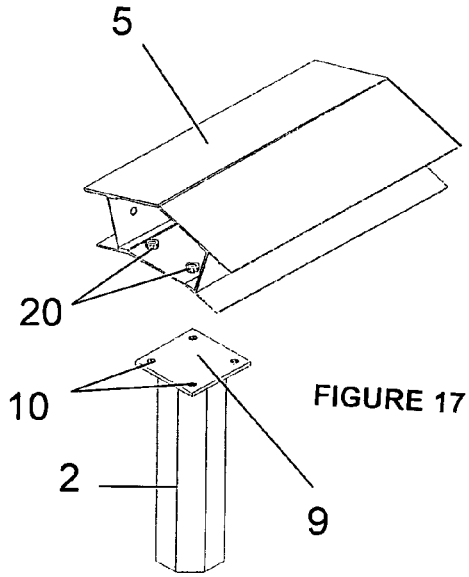
FIG. 17—perspective of the roof ridge connection.
Figure 18:
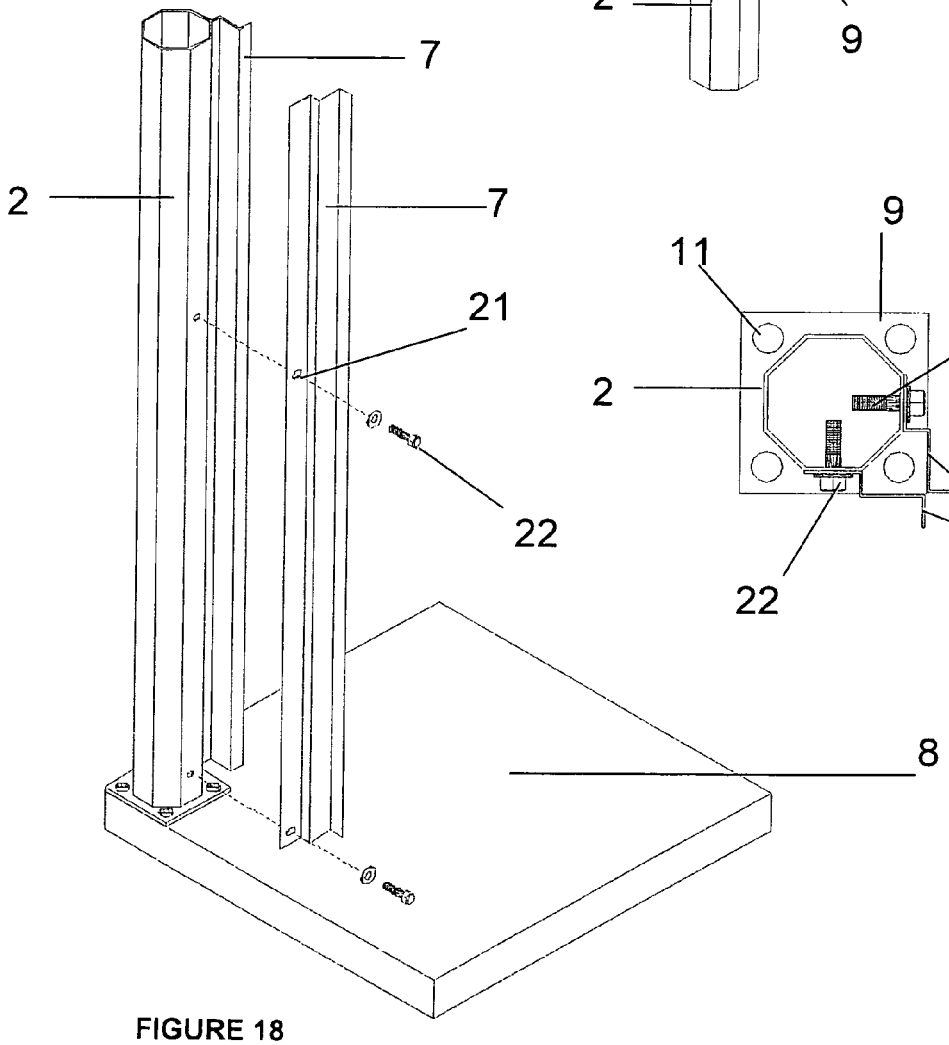
FIG. 18—exploded view of the connection of the internal wall bracing plates.
Figure 19:
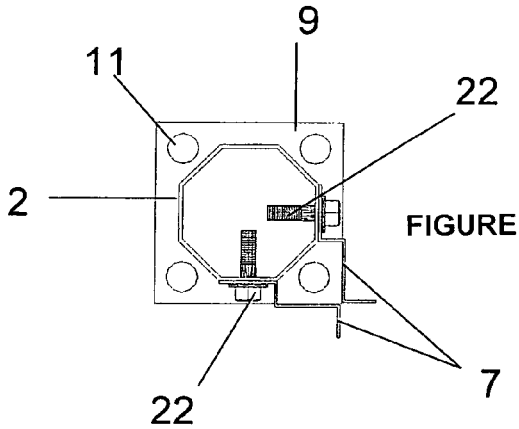
FIG. 19—upper view of the connection of the bracing plates.
Figure 20:
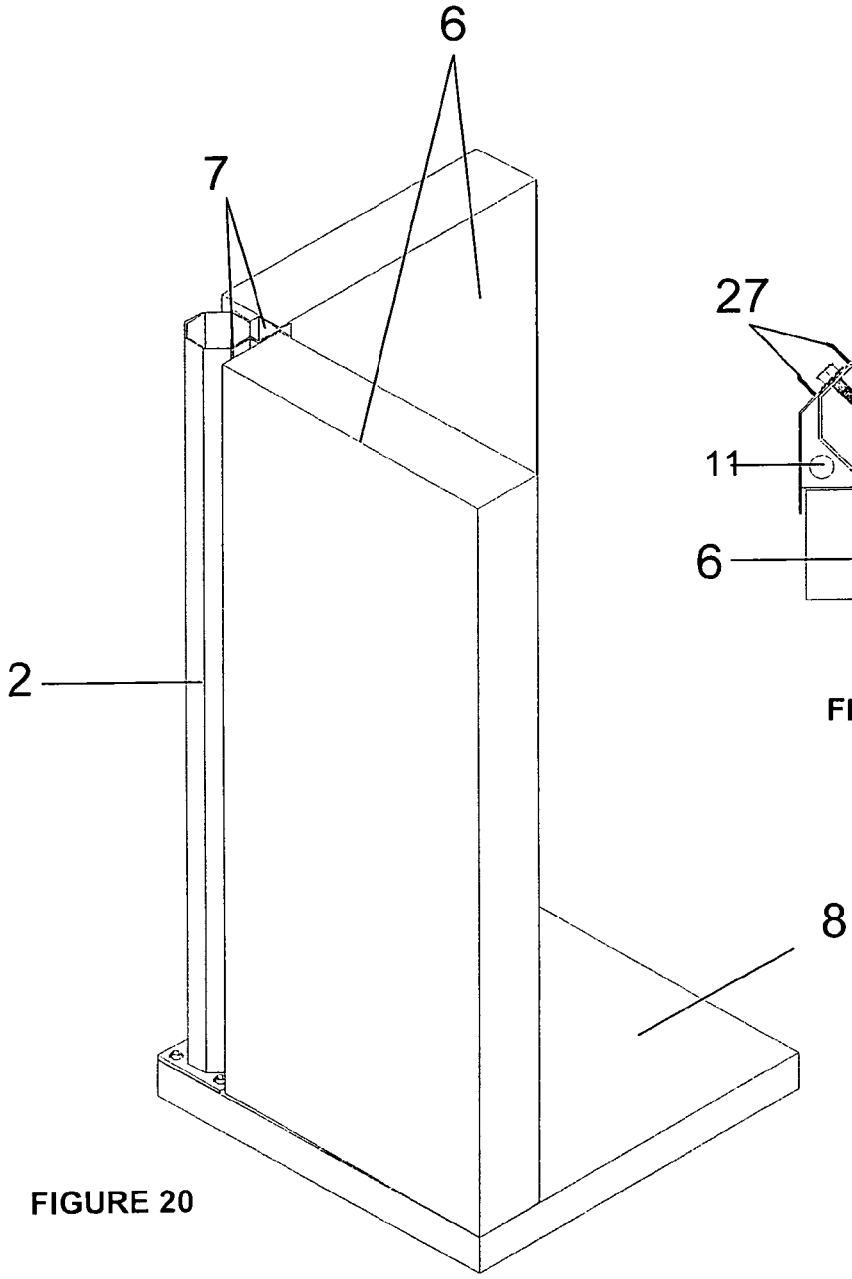
FIG. 20—perspective of the wall connection creating an edge column.
Figure 21:
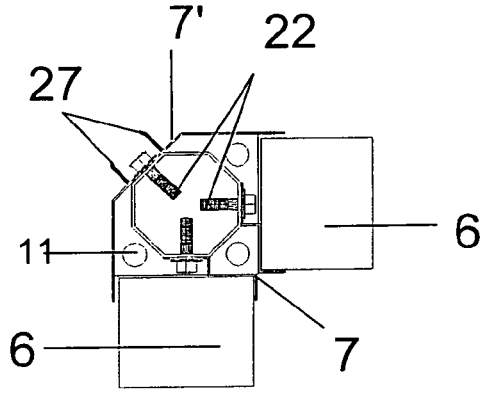
FIG. 21—upper view of the wall connection creating an edge column.
Figure 22:
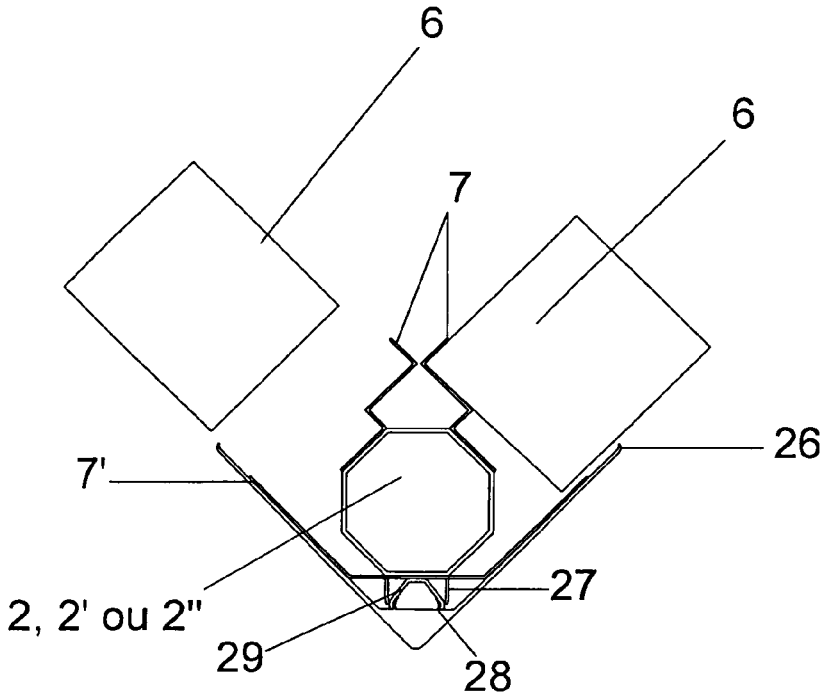
FIG. 22—upper view of the wall connection creating an edge column and connection of the finishing member.
Figure 23:
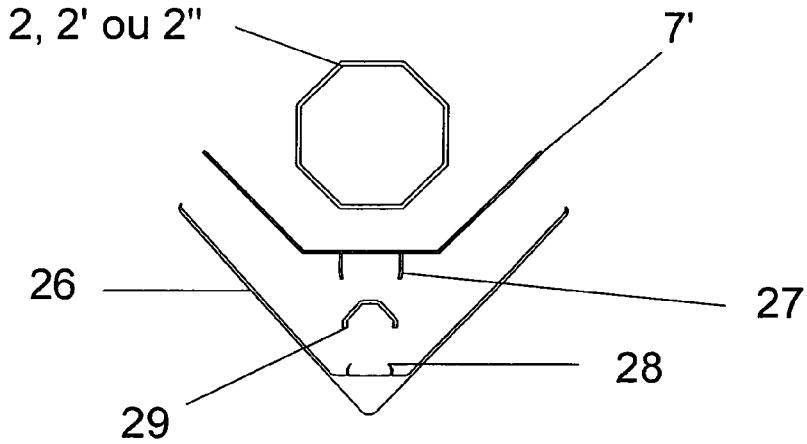
FIG. 23—exploded upper view of the wall connection assembly creating an edge column, clamp and finishing member.
Figure 24:
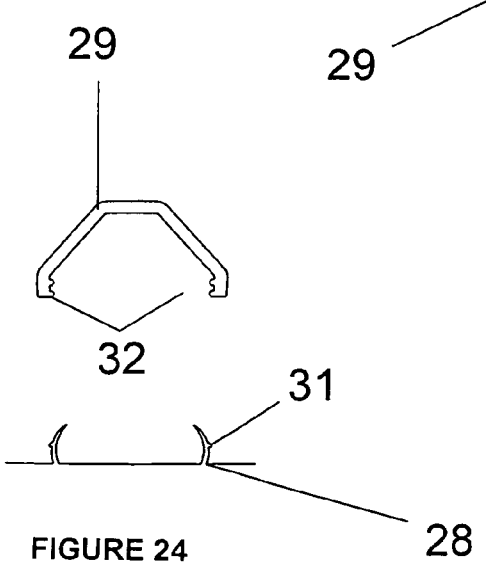
FIG. 24—detail of the finishing member connection to the bracing plates.

According to FIGS. 1 to 27 the proposed constructive arrangement to be applied to buildings comprises a steel structure (1) composed of octagonal tubing (2) which acts as columns, octagonal tubing (2') acting as external beams, octagonal tubing (2") acting as internal beams, structural connections (3), cross members (4) for the roof structure, hollow roof ridge members (5), panels (6) acting as structural walls and partitions, bracing plates (7), (7"), (7"), (7'''), to fasten the panels (6), external finishing member (26), and internal finishing member (30), with the entire structure anchored to a floor (8).

The octagonal tubing (2) that acts as columns is provided with a base at the lower end (9), with holes (10) for anchoring to the floor (8) or to the roof ridge (5) of the construction through bolts (11), with lock nuts (12) to connect and fasten the structural connections (3). The octagonal tubing (2') that acts as external beams is provided with curved supports (13), arranged so as to receive the cross members (4) of the roof, through holes (14), with ends provided with lock nuts (15) to connect and fasten the structural connections (3). The octagonal tubing (2") is also provided with lock nuts (15) for the structural connections (3).

The structural connections (3) shown in FIGS. 6 through 13, are designed to allow a perfect connection of the steel structure (1), with a provision of holes at the ends (16) to connect to the octagonal tubing (2, 2' and 2") by means of bolts (17), while also considering that the structural connection (3) applied over the octagonal tubing (2) which acts as columns, has the same inclined support (13) with holes (14) to receive the roof cross members (4), thus allowing for the necessary bracing of the steel structure (1).

The cross members (4), in their upper end, have an angled connection area (18) and holes (19) so as to allow the connection to the hollow roof ridge (5) by means of bolts (17) fastened to the lock nuts (20) of the hollow roof ridge (5) and slots (18') to connect to the inclined support (13) by means of bolts (17).

In the sequence we have the connection of the panels (6) to compose the external structural walls and construction partitions, which present the shape and dimension according to the module to be connected. That means the possibility of arranging a window, door or tilt window in a certain position. When an edge column is created to connect the panels (6) to the steel structure (1), internal bracing plates are used (7) provided with external angled shapes (7'), which have a "C" shape with holes along the length (21) for the bolts (22), and a connection slot (27), with a slightly curved end, to receive the external finishing member (26) through the internal clips (28) provided with a rim (31) to be connected to the clamp (29), through the recesses (32) arranged in the interior as illustrated in FIGS. 18, 19, 20, 21, 22, 23 and 24.

Figure 25:
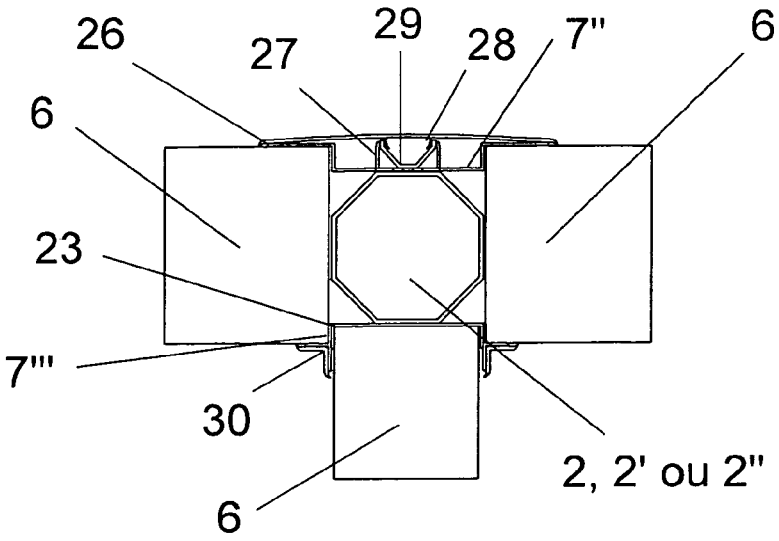
FIG. 25—upper view of the wall connection creating an intermediate column at the junction of three walls.
Figure 26:
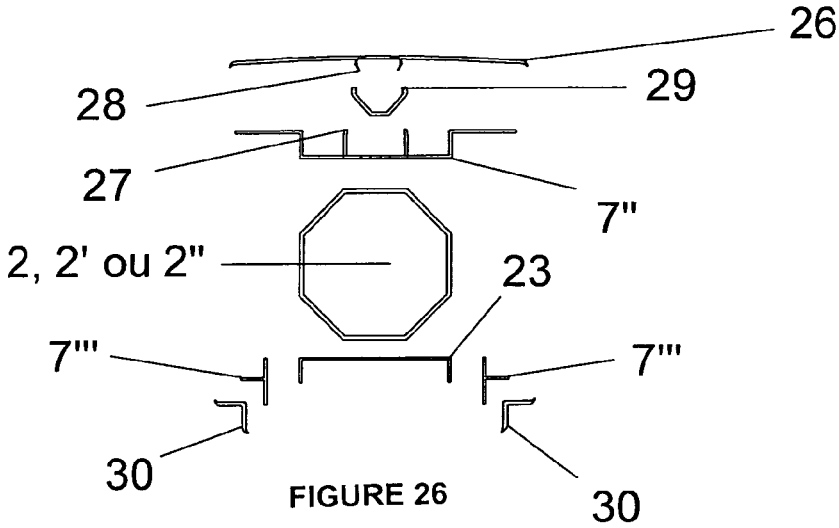
FIG. 26—exploded upper view of the wall connection assembly creating an intermediate column at the junction of three walls.
Figure 27:
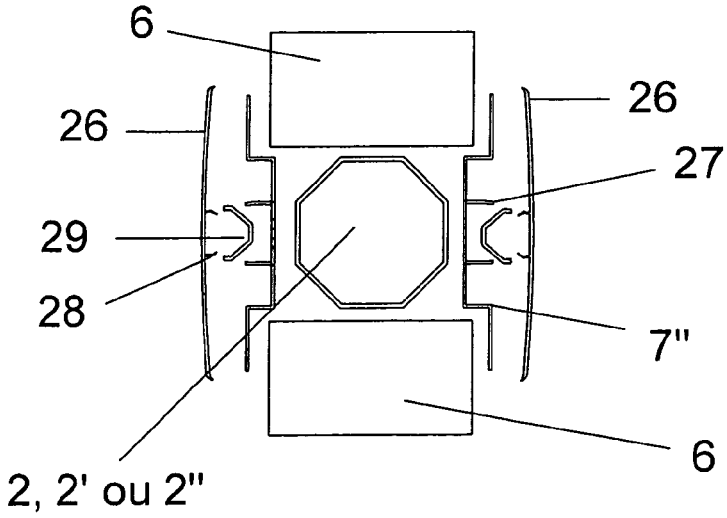
FIG. 27—exploded upper view of the wall connection assembly creating an intermediate column at the junction of two walls.

When there is a need for an intermediate column in a junction of three panels (6), a bracing plate will be used (7") with a connection slot (27) to receive the external finishing member (26) through the internal clips (28), provided with a rim (31) to connect to the clamp (29) through the recesses (32) arranged in the interior, being internally connected by means of the bracing plates (7'") with a "T" shape, furthermore connected by the spacer (23), to finally receive the internal finishing member (30) with an "L" shape, as illustrated in FIGS. 25 and 26, connected to the structural steel (1) octagonal tubing (2'), by means of bolts (22). In order to connect two panels (6) to compose an intermediate column, two bracing plates will be used (7") with a connection slot (27) to receive the external finishing member (26) by means of internal clips (28) with a rim (31) to be connected to the clamp (29) through recesses (32) arranged in the interior, as illustrated in FIG. 27.

As an example and obeying the order of connecting the internal bracing plate (7) to the octagonal tubing (2) we have the arrangement of the panel (6) close to this junction, and then with completion of the connection of the bracing plate (7') with the connection of the external finishing member (26) by means of a connection slot (27), internal clips (28), provided with a rim (31) to be connected to the clamp (29) through recesses (32) arranged in the interior, allowing the connection of the panels (6) to the steel structure (1) up to the construction closing and modular partition, as illustrated in FIGS. 18 through 27.

That which is claimed is:

1. A constructive arrangement applied to buildings comprising a steel structure, composed of:

octagonal tubing acting as columns and having a base disposed at a lower end of the columns with holes for anchoring to a floor, octagonal tubing acting as external beams, octagonal tubing acting as internal beams, wherein the columns, external beams and internal beams are interconnected via structural connections, wherein the octagonal tubing includes ends having lock nuts to connect and fasten the columns, external beams and internal beams to the structural connections; and wherein the structural connections include corresponding holes at ends thereof to connect to the ends of the octagonal tubing by means of bolts so as to allow a perfect union of the columns, external beams, internal beams, and structural connections, roof structure cross members having lower ends connected to the external beams and an opposite upper end connected to a hollow roof ridge member, wherein the upper end of the cross members include an angled connection area with holes so as to allow for the connection to the hollow roof ridge by means of bolts fastened to lock nuts arranged in an interior of the hollow roof ridge, and wherein the lower end of each cross member include slots to connect the cross members to an inclined support, by means of bolts, panels disposed between adjacent columns acting as structural walls and partitions, and, external finishing members and internal finishing members covering said columns, and wherein the octagonal tubing that acts as columns, has inclined supports with holes, to receive the roof cross members.

2. The constructive arrangement applied to buildings according to claim 1, further comprising an internal bracing plate and an external bracing plate for connecting the panels to the columns, wherein the internal and external bracing plates are attached to the columns opposite each other and are configured and arranged to engage opposite surfaces of a panel disposed therebetween to thereby connect the panels to the columns, and wherein the external bracing plate has a "C" shape.

3. The constructive arrangement applied to buildings according to claim 2, wherein the external finishing member is attached to the external bracing member.

4. The constructive arrangement applied to buildings according to claim 2, wherein the external bracing member includes a clamp that is configured and arranged to engage a corresponding internal clip disposed on the finishing member.

* * * * *